US005361656A

United States Patent [19]

Starr

[11] Patent Number: 5,361,656

[45] Date of Patent: Nov. 8, 1994

[54] STARR SOCKET ADAPTER

[76] Inventor: Robert W. Starr, 40 Malcolm St., Friday Harbor, Wash. 98250

[21] Appl. No.: 38,913

[22] Filed: Mar. 29, 1993

[51] Int. Cl.[5] ..... B25B 13/00

[52] U.S. Cl. ..... 81/180.1; 81/177.85

[58] Field of Search ..... 81/180.1, 185.2, 177.85, 81/177.2, 177.1, 60–63.2, 125, 900

[56] References Cited

U.S. PATENT DOCUMENTS 2,982,160 5/1961 Little ..... 81/60

4,344,340 8/1982 Erickson ..... 81/177.85 X

*Primary Examiner*—D. S. Meislin

[57] ABSTRACT

An improved socket adapter system wherein an adapter cavity is positioned internal of the adapter fitting resulting in no significant displacement of a wrench arm system and wherein the adapter is magnetically fixed to the wrench arm/socket system. An adapter of this configuration may be used individually or in conjunction with other size adapters of the same configuration to mate a plurality of wrench arms to a plurality of sockets allowing for manipulation of fasteners in extremely tight and difficult to access places.

2 Claims, 1 Drawing Sheet

STARR SOCKET ADAPTER

TECHNICAL FIELD

The present invention is directed toward apparatus for use with a socket wrench and, more particularly, toward an adapter for interfacing a wrench arm of a socket wrench with a plurality of sockets, related attachments and accessories.

BACKGROUND OF INVENTION

Socket wrench systems for positioning fasteners with respect to structures have been known for some Lime. Typically, the socket wrench includes a wrench arm having a gripping end and an engaging end. The engaging end is usually provided with an upright fitting, extending therefrom and constructed to mate with a cavity of a socket. The primary advantage of a socket wrench system is that a number of sockets can be provided for mating with fasteners of varying geometry.

Usually, each socket will include a fastener engaging end and a wrench arm engaging end. The wrench arm engaging end of each socket is provided with a socket cavity having a geometry constructed to mate with the upright fitting of the wrench arm. Each fastener engaging end of the sockets is provided with a unique geometry so that the plurality of sockets may be mated with fasteners of varying geometries. Accordingly, the sockets can be used in combination with a single wrench arm for positioning fasteners of varying geometries.

However, prior art wrench arm systems are limited in that the sockets must include a socket cavity constructed to mate with the upright fitting of the wrench arm. Accordingly, it is desirable to provide apparatus for interfacing a wrench arm with sockets having socket cavities of varying geometry.

SUMMARY OF THE INVENTION

The present invention provides a magnetic interlocking adapter for a socket wrench wherein the socket wrench includes a wrench arm and a plurality of sockets. The wrench arm has an upright fitting of a predetermined geometry. A first portion of the plurality of sockets each includes a socket cavity having a predetermined geometry that is constructed to mate with the upright fitting of the wrench arm. A second portion of the plurality of sockets each includes a socket cavity having a predetermined geometry that does not mate with the upright fitting of the wrench arm. The adapter is provided for interfacing the wrench arm with the socket cavities of the second portion of the plurality of sockets wherein the adapter cavity is positioned internal of the adapter fitting minimizing the over all length or displacement of the adapter.

Each adapter includes a rim portion having a support seating side, a fitting support side, a gripping surface intermediate the support seating side and the fitting support side, and two small cylindrical magnets pressed into the rim portion for the purpose of fixing the wrench arm to the adapter and the adapter to the socket.

The adapter also includes an adapter cavity positioned on the support seating side of the rim portion and continuing through the rim portion and into the adapter fitting. The adaptor cavity is constructed with a geometry selected to mate with the upright fitting of the wrench arm so that the upright fitting is received in the adapter cavity. The adapter further includes an adapter fitting positioned on the fitting support side and extending outward therefrom. The adapter fitting is constructed with a geometry selected to mate with the socket cavities of the second portion of the plurality of sockets so that the adapter fitting is received in the socket cavity of the second plurality of sockets to thereby interface the wrench arm with the second plurality of sockets.

DETAILED DESCRIPTION OF THE INVENTION

Figure 1:
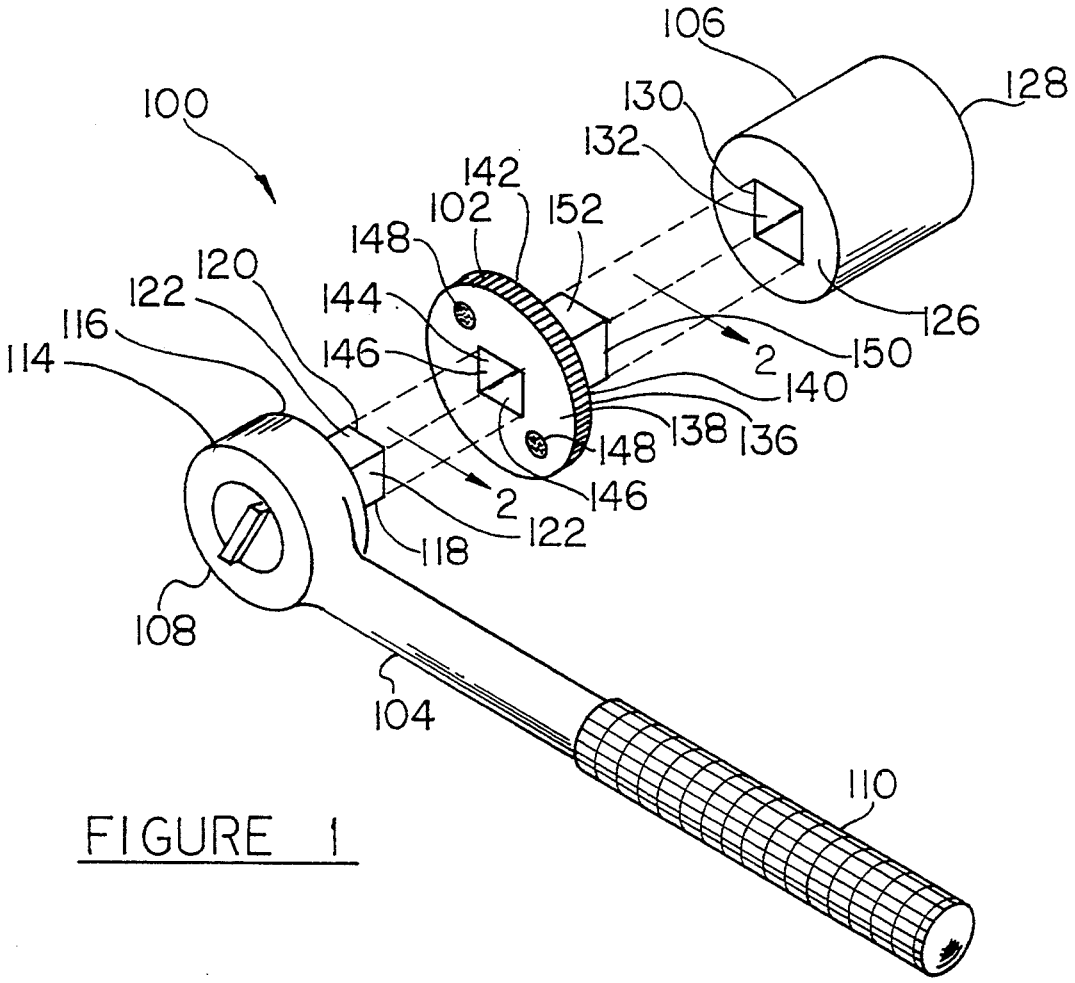
FIG. 1 is an isometric view of the improved socket wrench system of the subject invention.
Figure 2:
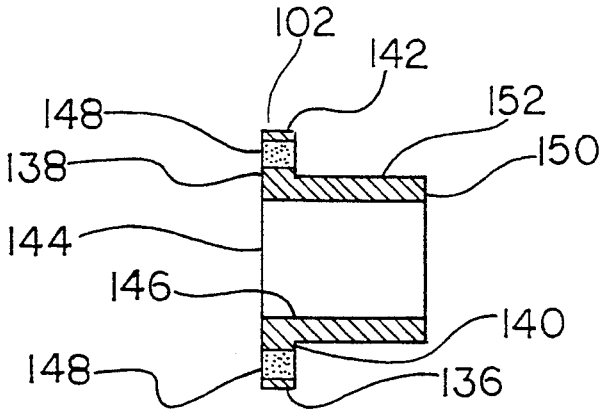
FIG. 2 is a cross-sectional view of the adapter illustrated in FIG. 1.

A wrench arm system 100, illustrated in FIG. 1, includes an adapter 102 for interfacing a wrench arm 104 with a socket 106. As is known in the art, a plurality of sockets 106 may be provided for engaging a plurality of fasteners, having varying geometries, as will be discussed in more detail below.

The wrench arm 104 includes an engaging end 108 and a gripping end 110 opposite the engaging end.

The engaging end 108 has a cylindrical fitting support 114 fixed thereto. The fitting support includes a substantially circular support surface 116 having a upright fitting 118 extending therefrom. The upright fitting 118 is positioned at substantially the center of the support surface 116, although such positioning is not a requirement of the present invention. The upright fitting 118 has a top end 120 that is remote from the fitting support surface 116. The upright fitting 118 also includes four sides 122 extending between the top end 120 and the fitting support surface 116. The four sides 120 are constructed to provide a substantially rectangular cross-section for the upright fitting 118.

The socket 106 is a substantially cylindrical member having a fitting engaging surface 126 positioned opposite a fastener engaging surface 128. The fastener engaging surface typically includes a structure for engaging a fastener of predetermined geometry. As is known in the art, a plurality of sockets 106 are typically provided with varying geometry on the fastener engaging surface 128 so that the plurality of sockets may be used to interface the wrench arm 104 with a plurality of fasteners having varying geometries.

The fitting engaging surface 126 includes a fitting cavity 130 situated at substantially the center of the fitting engaging surface 126. The fitting cavity includes four sides 132 that are constructed so that the socket cavity 130 has a substantially rectangular cross-section.

The adapter 102 includes a disk-shaped, cylindrical rim portion 136. The rim portion 136 includes a support seating side 138, a fitting support side 140, and a gripping surface 142 intermediate the support seating side 138 and the fitting support side 140. The rim portion 136 is a substantially disk-shaped member constructed to facilitate handling of the adapter 102 by the user, and incorporates two cylindrical magnets 148 which are pressed into the rim portion 136 for the purpose of fixing the fitting support surface 116 of the wrench arm 104 to the support seating side 138 of the adapter 102 and the fitting support side 140 of the adapter 102 to the fitting engaging surface 126 of the socket 106. As will be described in more detail below, the rim portion 136 is relatively thin in comparison to the overall length of the adapter 102.

The support seating side 138 and the fitting support side 140 of the rim portion 136 are each substantially circular.

The support seating side has an adapter cavity 144 that is positioned at the center of the support seating side 138 and protrudes through the rim portion 136 and the adapter fitting 150. The adapter cavity has four sides 146 that are constructed to provide a substantially rectangular cross-section for the adapter cavity.

The adapter cavity is constructed with a substantially rectangular cross-section to mate with the rectangular cross-section of the upright fitting 118 so that the upright fitting is received within the adapter cavity 144.

The fitting support side 140 includes an adapter fitting 150 extending outward therefrom. The adapter fitting 150 is positioned at the center of the fitting support side 140. The adapter fitting 150 includes four ides 152 constructed to provide the adapter fitting 150 with a rectangular cross-section so that the adapter fitting can be received in the socket cavity 130 or next larger adapter cavity 144. Like the adapter cavity 144, the cross-section of the adapter fitting 150 may be varied to mate with varying constructions of the socket cavity 130. More particularly, the user may have a plurality of sockets wherein a first portion includes a socket cavity of a first predetermined geometry and wherein a second portion includes a socket cavity having a second predetermined geometry. Advantageously, two adapter 102 can be provided wherein a first adapter includes a fitting 150 constructed to mate with the socket cavities of the first plurality of sockets and wherein a second adapter includes a fitting 150 constructed to mate with the second plurality of socket cavities. In this manner, both the first and second plurality of sockets may be used with the wrench arm 104 even though neither the socket cavities of the first plurality nor the second plurality of sockets mates with the fitting 118 of the wrench arm 104. In this manner, the adapter 102 is provided to interface the wrench arm 104 with the plurality of sockets having varying geometries of socket cavity 130.

An important and unique feature of the present invention is that the adapter cavity 144 extends through the rim portion 136 and internal of the adapter fitting 150. By permitting the adapter cavity 144 to extend through the adapter fitting 150, the over length of the adapter 102 is minimized. Further, by making the thickness of the rim portion 136 small in comparison to the length of the adapter fitting 150, the over length of the adapter 102 is further minimized. Accordingly, use of the adapter 102 does not substantially increase the distance that the socket 106 is positioned from the wrench arm 104.

It will be appreciated that, although specific embodiments of the invention have been described herein for purposes of illustration, various modifications may be made without departing from the spirit and scope of the invention. Accordingly, the invention is not limited except as by the appended claims.

What is claimed is,

1. An adapter for a socket wrench wherein the socket wrench includes a wrench arm and a plurality of sockets, the wrench arm including an upright fitting of a predetermined geometry, a first portion of the plurality of sockets each including a socket cavity having a predetermined geometry that is constructed to mate with the upright fitting of the wrench arm and a second portion of the plurality of sockets each including a socket cavity having a predetermined geometry that does not mate with the upright fitting of the wrench arm, said adapter being provided for interfacing the wrench arm with the socket cavities of the first portion of the plurality of sockets, said adapter comprising:

A rim portion, said rim portion being a disk-shaped member having a support seating side, a fitting support side, and a gripping surface intermediate said support seating side and said fitting support side;

An adapter cavity positioned on said support seating side of said rim portion extending through said rim portion and fitting support side, said adapter cavity being constructed with a geometry selected to mate with the upright fitting of the wrench arm so that the upright fitting is received in the adapter cavity;

An adapter fitting positioned on said fitting support side and extending outward therefrom, said adapter fitting being constructed with a geometry selected to mate with the socket cavities of the first portion of the plurality of sockets so that said adapter fitting is received in the socket cavity of the second plurality of sockets to thereby interface the wrench arm with said second plurality of sockets, and wherein said adapter cavity is constructed to extend through said rim portion of said adapter and through said adapter fitting so that when said socket adapter is positioned intermediate said socket and said wrench arm the displacement of said socket from said wrench arm is minimized.

2. The adapter as recited in claim 1 where the rim portion of said adapter contains two small cylindrical magnets pressed through said rim portion for the purpose of fixing the adapter support seating side to the support surface of a wrench arm, and the fitting support side of said adapter to a fitting engaging surface of a plurality of sockets.

* * * * *